US009381628B1

(12) United States Patent
Garza

(10) Patent No.: US 9,381,628 B1
(45) Date of Patent: Jul. 5, 2016

(54) WRENCH WITH ADJUSTABLE LENGTH HANDLE

(71) Applicant: Roy J. Garza, Huntington Beach, CA (US)

(72) Inventor: Roy J. Garza, Huntington Beach, CA (US)

( * ) Notice: Subject to any disclaimer, the term of this patent is extended or adjusted under 35 U.S.C. 154(b) by 387 days.

(21) Appl. No.: 13/934,882

(22) Filed: Jul. 3, 2013

(51) Int. Cl.
*B25B 23/16* (2006.01)

(52) U.S. Cl.
CPC ..... *B25B 23/16* (2013.01)

(58) Field of Classification Search
CPC .... B25B 13/463; B25B 15/04; B25B 13/465; B25B 13/468; B25B 46/461; B25B 17/00; B25B 23/16
See application file for complete search history.

(56) References Cited

U.S. PATENT DOCUMENTS 4,485,702 A * 12/1984 Swan et al. ..... 81/98
4,589,307 A * 5/1986 Parker ..... 81/62
4,905,548 A 3/1990 Colace et al.
5,309,796 A * 5/1994 Jones ..... 81/57.39
5,671,643 A 9/1997 Henkhaus
5,771,761 A 6/1998 Binkowski
6,112,625 A 9/2000 Turtle
6,138,533 A 10/2000 Turtle
D473,768 S 4/2003 Gilmore
7,000,897 B2 * 2/2006 Chick ..... 251/293
7,182,000 B1 * 2/2007 Dicksen ..... 81/177.2
8,065,938 B1 * 11/2011 Kravitch ..... 81/177.2
8,601,913 B2 * 12/2013 Armes ..... 81/177.2
2005/0028649 A1 * 2/2005 Settanni ..... 81/111
2006/0207393 A1 * 9/2006 Stupar ..... 81/177.75

* cited by examiner

*Primary Examiner* — Robert Scruggs

(57) ABSTRACT

The present invention features a hardware tool with adjustable length separable into two independent tools. The device includes a handle with an adjustment pin disposed on the exterior of the handle and a hollow tube with a plurality of holes aligned and disposed on the exterior of the tube. A ratchet fixedly attached to the tube, wherein the ratchet comprises a ratchet key and a push latch to change the allowable rotation direction. An open-end wrench or a pipe wrench head is removably attached to the handle, wherein the wrench comprises a hardware head and a socket adapter, wherein the socket adapter is adaptive to snuggly fit into a locking collar disposed on the handle.

9 Claims, 6 Drawing Sheets

WRENCH WITH ADJUSTABLE LENGTH HANDLE

FIELD OF THE INVENTION

The present invention is related to a hardware tool with adjustable length, and more particularly to a hardware tool with adjustable length separable into two independent tools.

BACKGROUND OF THE INVENTION

Many craftsmen found that it is difficult to tighten or untighten certain bolts or pipes. A long handle is typically needed for such kind of work. However, the long handle adds weight and cost to the hardware. It would also be inconvenient to use a long handle hardware tool for light load applications. Hence, there is a need for a flexible hardware tool with normal sized handle for light load work and extendable handle for heavy load jobs.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a hardware tool system with adjustable length separable into two independent tools. The device includes a handle with an adjustment pin disposed on the exterior of the handle and a hollow tube with a plurality of holes aligned and disposed on the exterior of the tube. A ratchet fixedly attached to the tube, wherein the ratchet comprises a ratchet key and a push latch to change the allowable rotation direction. An open-end wrench or a pipe wrench head is removably attached to the handle, wherein the wrench comprises a hardware head and a socket adapter, wherein the socket adapter is adaptive to snuggly fit into a locking collar disposed on the handle.

DESCRIPTION OF PREFERRED EMBODIMENTS

Figure 1:
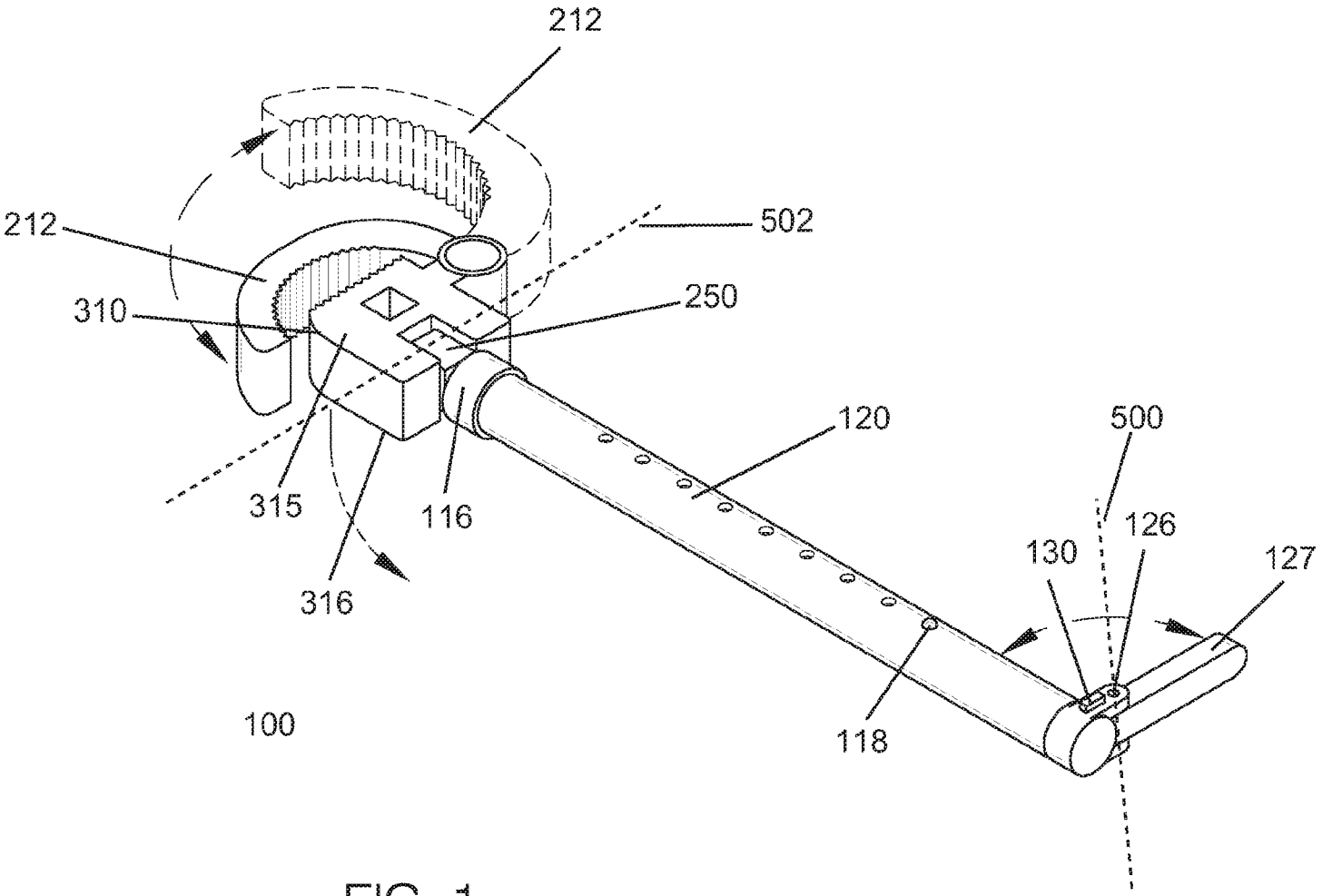
FIG. 1 shows a component view of the hardware tool device. Ratchet key (127) rotates on pivot (126) about axis A (500), and base (310) rotates on pivot (250) about axis B, wherein axis A is perpendicular to axis B (502).

Referring now to FIGS. 1-7, the present invention features a hardware tool system (100) comprising a handle (110) with an adjustment pin disposed on the exterior of the handle and a hollow tube (120) with a plurality of holes aligned and disposed on the exterior of the tube. A ratchet fixedly attached to the tube, wherein the ratchet comprises a ratchet key and a push latch to change the allowable rotation direction. An open-end wrench or a pipe wrench head is removably attached to the handle, wherein the wrench comprises a hardware head and a socket adapter, wherein the socket adapter is adaptive to snuggly fit into a locking collar disposed on the handle.

The handle (110) has a first end (112) and a second end (114), wherein a locking collar (116) is disposed on the first end (112), an adjustment pin (118) is disposed on the exterior of the handle (110).

The hollow tube (120) has a first end (122) and a second end (124), wherein the tub is adaptive to snugly fit the handle (110), wherein a plurality of holes (125) is aligned and disposed on the exterior of the tube (120), wherein the holes (125) is adaptive to snuggly fit the adjustment pin (118), wherein the distance between the first end (112) of the handle (110) and the second end (124) of the tube (120) is adjustable via choosing the desired hole (125) to receive the adjustment pin (118) after the second end of the handle inserted into the first end of the tube.

A ratchet fixedly attached to the second end (124) of the tube (120), wherein the ratchet comprising a ratchet key (127) and a push latch (130), wherein the ratchet key comprises a distal end (129) and proximal end (128), wherein the ratchet key is only rotatable in one direction, wherein the push latch (127) is pushed to change the allowable rotation direction. In some embodiments, the ratchet key (127) is an allen key, Torx key, flat head key, or a Philips head key, etc.

A second hardware (200) is removably attached to the first end of handle (110), wherein the second hardware comprises a hardware head (210), a first hinge (250) and a socket adapter (218), wherein the socket adapter (218) is adaptive to snuggly fit into the locking collar (116) is disposed on the first end (112) of the handle (110), wherein the hardware head (210) connected to the socket adapter (218) via the first hinge (250) such that the hardware head (210) is able to rotate around the first hinge (250). The first hinge (250) enables the hardware (200) to be functioned from left side or right side where space is limited for operation.

The ratchet and the second hardware is able to be used independently matched with the tube and handle respectively, wherein the ratchet and the second hardware is also able to combine together as a one piece tool by insertion of the handle (110) into the tube (120).

In some embodiments, the hardware head (210) is an open-end wrench. In some embodiments, the hardware head (210) is a box-end wrench. In some embodiments, the hardware head (210) is an adjustable wrench.

In some embodiments, the hardware head (210) is a pipe wrench head. The pipe wrench head comprises an arc-shaped arm (212) and a base (310). The arm (212) has a first end (213), a second end (214), an outside surface (215) and inside surface (216), wherein a plurality of teeth (217) is disposed on the inside surface (216). The base (310) has a top side (311), a bottom side (312), a first side (313), a second side (314), a front side (315) and a back side (316), wherein a plurality of teeth (217) is disposed on the top side (311). The first side of the base (310) is connected to the second end (214) of the arc-shaped arm (212) via a second hinge (219) such that the arc-shaped arm (212) is pivotable with the base (310), wherein the teeth (217) securely grips a pipe (400).

Figure 2:
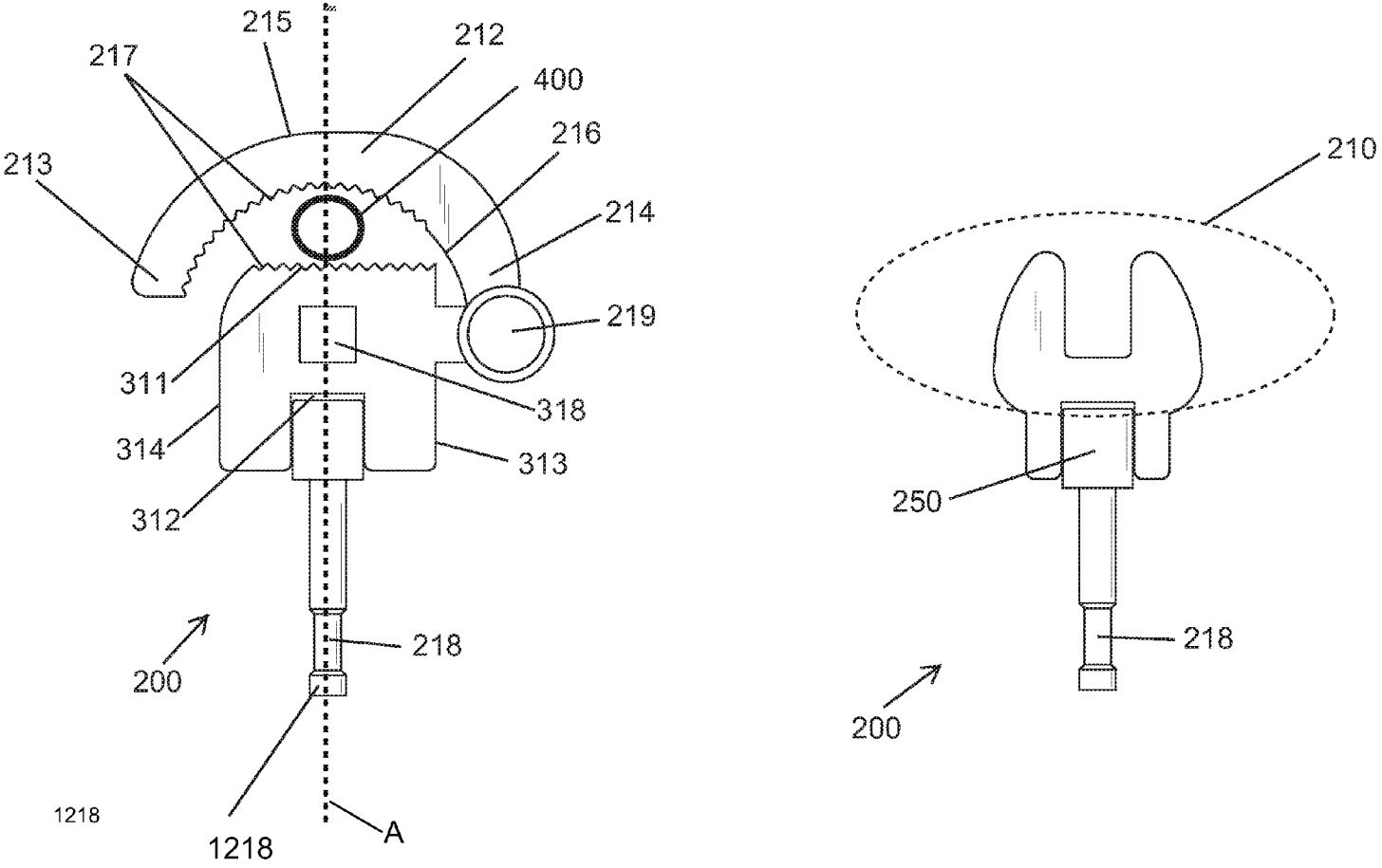
FIG. 2 shows two variations of the hardware tool device.
Figure 3:
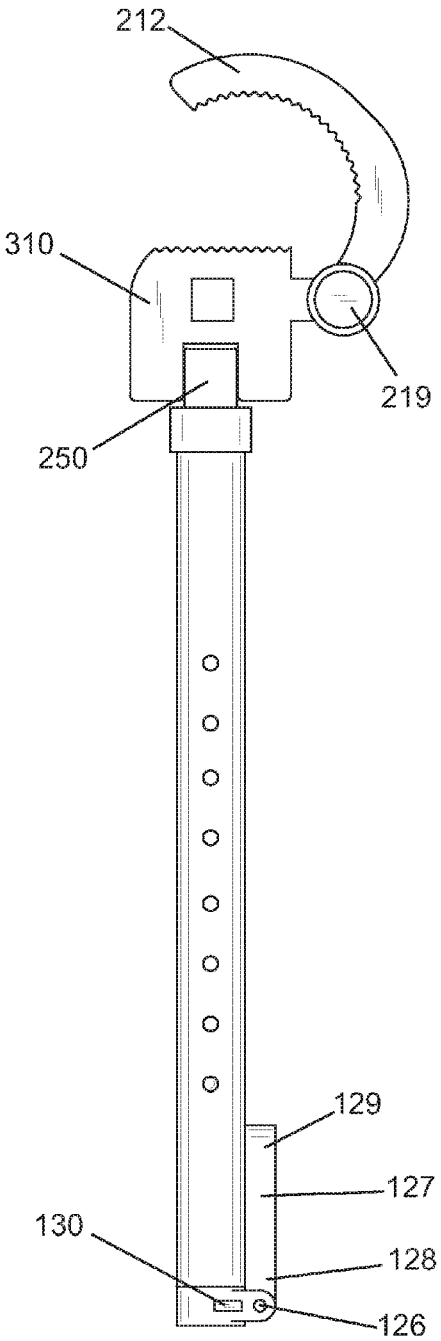
FIG. 3 shows a side view of the hardware tool device.
Figure 4:
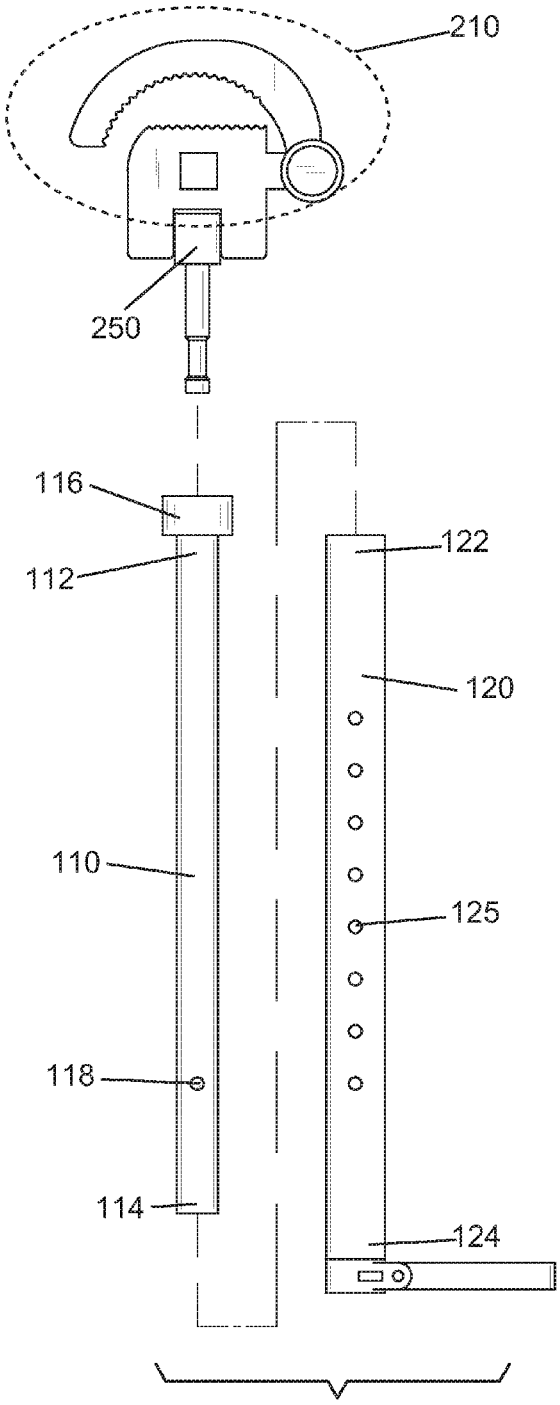
FIG. 4 shows an assembling view of the hardware tool device.
Figure 5:
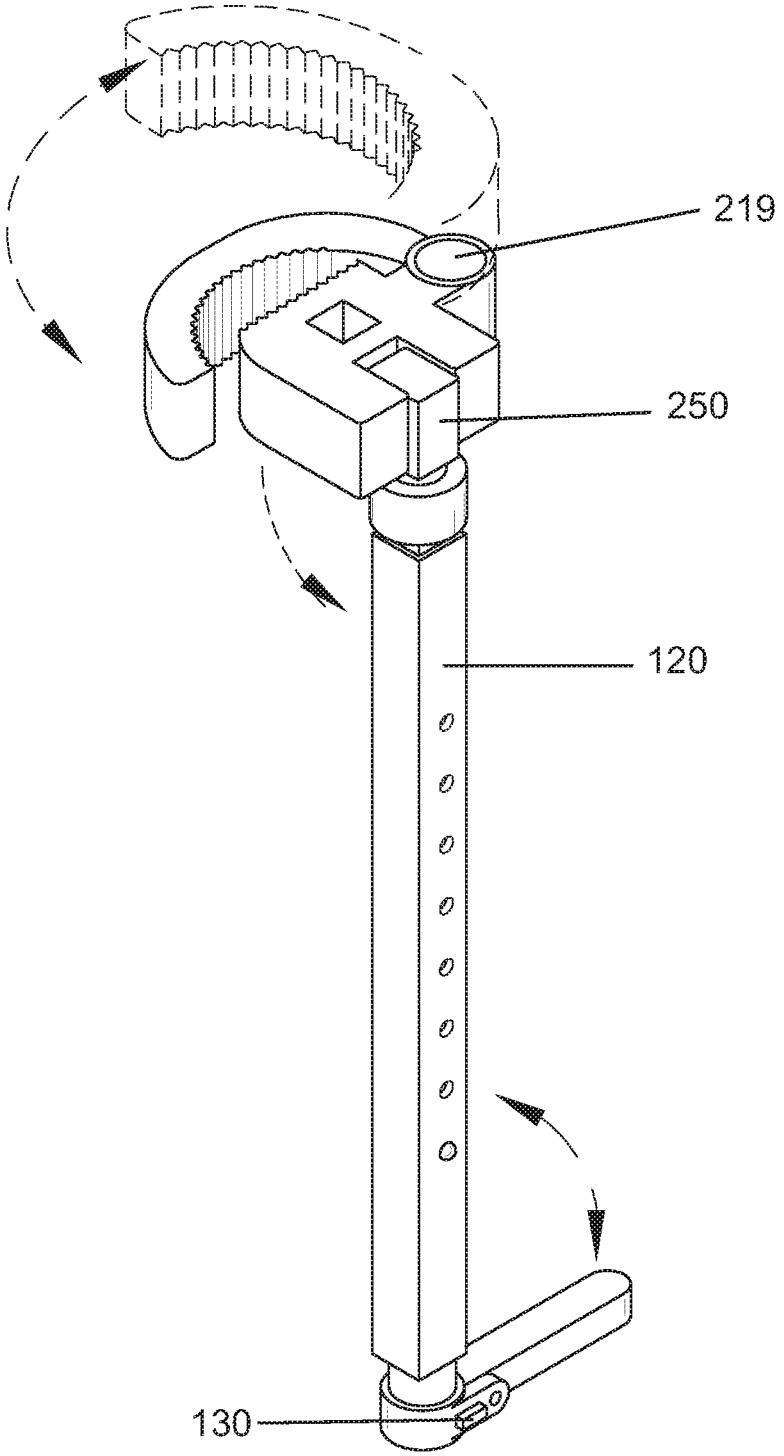
FIG. 5 shows an alternative embodiment with square tube.
Figure 6:
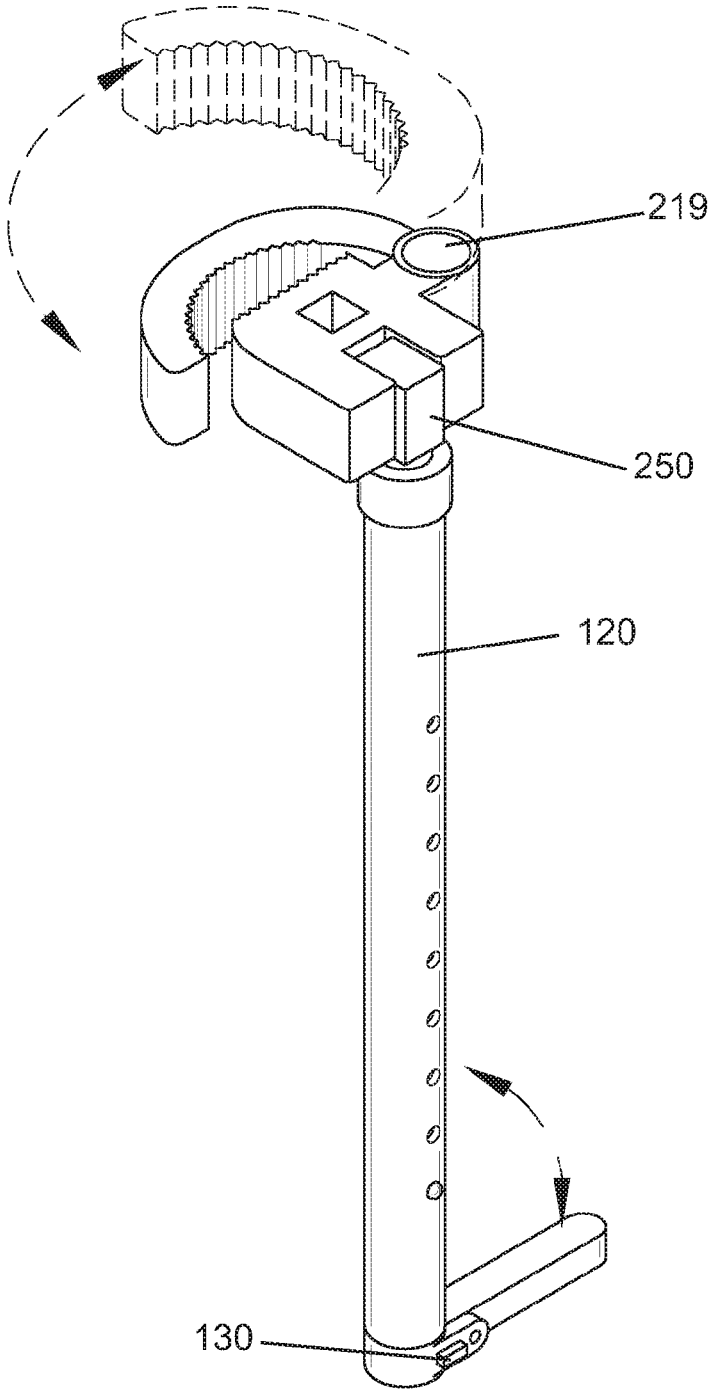
FIG. 6 shows another alternative embodiment with round tube.
Figure 7:
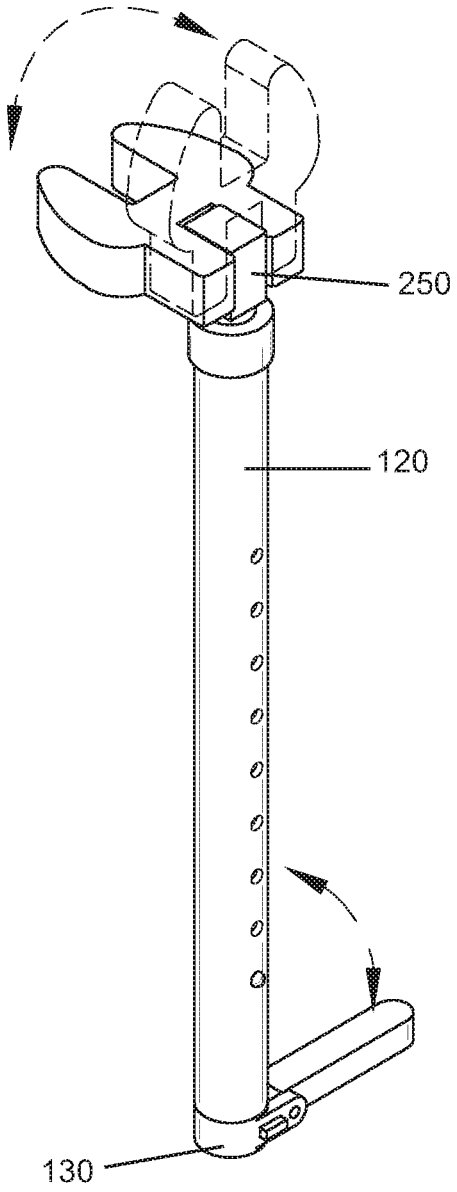
FIG. 7 shows a perspective view of the hardware tool device in motion.

In some embodiments, the second side (314) of the base (310) has a convex curvature which matches to the concave curvature of the inside surface (216) of the arc-shaped arm (212). As shown in FIG. 2, when the arc-shaped arm (212) is pivoted to a close position, the inside surface (216) of the arc-shaped arm (212) encloses the second side (314) of the base (310) in parallel. Such arrangement would enable the pipe wrench close further and thus have more teeth (217) to contact the pipe (400), especially when the pipe has small diameter.

In some embodiments, the base (310) further comprises an aperture (318) within the base, wherein the aperture goes through the front side (315) to the back side (316). In some embodiments, the aperture is square. The aperture lowers the weight of the base and also provides a means to hang the base to any external hooks, such as hooks on a wall.

In some embodiments, the system further comprises a third hinge (126) disposed in the proximal end (128) of the ratchet key (127), wherein the ratchet key (127) is pivotable between a storage position and deployed position around the second end (124) of the tube (110), wherein at storage position, the ratchet key (127) is flipped to adjacent to the tube (120), wherein at deployed position, the ratchet key (127) is perpendicular to the tube (120).

The disclosures of the following U.S. Patents are incorporated in their entirety by reference herein: U.S. Pat. No. 5,771,761, U.S. Pat. No. 6,112,625, U.S. Pat. No. 6,138,533, U.S. Pat. No. D473,768, U.S. Pat. No. 4,905,548, and U.S. Pat. No. 5,671,643.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A hardware tool system with adjustable length, the tool (100) comprising:

a) a handle (110) with a first end (112) and a second end (114), wherein a locking collar (116) is disposed on the first end (112), an adjustment pin (118) is disposed on the exterior of the handle (110);

b) a hollow tube (120) with a first end (122) and a second end (124), wherein the tube is adaptive to snuggly fit the handle (110), wherein a plurality of holes (125) is aligned and disposed on the exterior of the tube (120), wherein the holes (125) is adaptive to snuggly fit the adjustment pin (118), wherein the distance between the first end (112) of the handle (110) and the second end (124) of the tube (120) is adjustable via choosing the desired hole (125) to receive the adjustment pin (118) after the second end of the handle inserted into the first end of the tube;

c) a ratchet fixedly attached to the second end (124) of the tube (120), wherein the ratchet comprising a ratchet key (127) and a push latch (130), wherein the ratchet key comprises a distal end (129) and proximal end (128), wherein the ratchet key is only rotatable in one direction, wherein the push latch (130) is pushed to change the allowable rotation direction;

d) a second hardware (200) removably attached to the first end of handle (110), wherein the second hardware comprises a hardware head (210), a first hinge (250) and a socket adapter (218), wherein the socket adapter has a round telescopic end (1218) which is adaptive to snuggly fit into the locking collar (116) disposed on the first end (112) of the handle (110) and the socket adapter (218) with the round telescopic end (1218) freely rotates around a vertical axis (A), wherein the hardware head (210) connected to the socket adapter (218) via the first hinge (250) such that the hardware head (210) is able to rotate around the first hinge (250); and wherein the ratchet and the second hardware is able to be used independently matched with the tube and handle respectively, wherein the ratchet and the second hardware is also be able to combine together as a one piece tool by insertion the handle (110) into the tube (120).

2. The system of claim 1, wherein the hardware head (210) is an open-end wrench.

3. The system of claim 1, wherein the hardware head (210) is a box-end wrench.

4. The system of claim 1, wherein the hardware head (210) is an adjustable wrench.

5. The system of claim 1, wherein the hardware head (210) is a pipe wrench head, wherein the pipe wrench head comprising:

a) an arc-shaped arm (212) with a first end (213) and a second end (214), wherein the arm (212) comprises an outside surface (215) and inside surface (216), wherein a plurality of teeth (217) is disposed on the inside surface (216);

b) a base (310), wherein the base has a top side (311), a bottom side (312), a first side (313), a second side (314), a front side (315) and a back side (316), wherein a plurality of teeth (217) is disposed on the top side (311); and wherein the first side of the base (310) is connected to the second end (214) of the arc-shaped arm (212) via a second hinge (219) such that the arc-shaped arm (212) is pivotable with the base (310), wherein the teeth (217) securely grips a pipe (400).

6. The system of claim 5, wherein the base (310) further comprises an aperture (318) within the base, wherein the aperture goes through the front side (315) to the back side (316).

7. The system of claim 6, wherein the aperture is square.

8. The system of claim 1, wherein the system further comprises a third hinge (126) disposed in the proximal end (128) of the ratchet key (127), wherein the ratchet key (127) is pivotable between a storage position and deployed position around the second end (124) of the tube (110), wherein at storage position, the ratchet key (127) is flipped to adjacent to the tube (120), wherein at deployed position, the ratchet key (127) is perpendicular to the tube (120).

9. A hardware tool system with adjustable length, the tool (100) consisting of:

a) a handle (110) with a first end (112) and a second end (114), wherein a locking collar (116) is disposed on the first end (112), an adjustment pin (118) is disposed on the exterior of the handle (110);

b) a hollow tube (120) with a first end (122) and a second end (124), wherein the tube is adaptive to snuggly fit the handle (110), wherein a plurality of holes (125) is aligned and disposed on the exterior of the tube (120), wherein the holes (125) is adaptive to snuggly fit the adjustment pin (118), wherein the distance between the first end (112) of the handle (110) and the second end (124) of the tube (120) is adjustable via choosing the desired hole (125) to receive the adjustment pin (118) after the second end of the handle inserted into the first end of the tube;

c) a ratchet fixedly attached to the second end (124) of the tube (120), wherein the ratchet consist of a ratchet key (127) and a push latch (130), wherein the ratchet key consists of a distal end (129) and proximal end (128), wherein the ratchet key is only rotatable in one direction, wherein the push latch (130) is pushed to change the allowable rotation direction;

d) a second hardware (200) removably attached to the first end of handle (110), wherein the second hardware consists of a hardware head (210), a first hinge (250) and a socket adapter (218), wherein the socket adapter has a round telescopic end (1218) which is adaptive to snuggly fit into the locking collar (116) disposed on the first end (112) of the handle (110) and the socket adapter (218) with the round telescopic end (1218) freely rotates around a vertical axis (A), wherein the hardware head (210) connected to the socket adapter (218) via the first hinge (250) such that the hardware head (210) is able to rotate around the first hinge (250); and wherein the ratchet and the second hardware is able to be used independently matched with the tube and handle respectively, wherein the ratchet and the second hardware is also be able to combine together as a one piece tool by insertion the handle (110) into the tube (120).

* * * * *